US007002332B2

(12) United States Patent
Chen et al.

(10) Patent No.: US 7,002,332 B2
(45) Date of Patent: Feb. 21, 2006

(54) SOURCE AND SINK VOLTAGE REGULATOR

(75) Inventors: An-Tung Chen, Hsinchu (TW); Ching-Wei Hsueh, Taipei (TW)

(73) Assignee: Winbond Electronics Corporation, (TW)

( * ) Notice: Subject to any disclaimer, the term of this patent is extended or adjusted under 35 U.S.C. 154(b) by 0 days.

(21) Appl. No.: 10/971,944

(22) Filed: Oct. 21, 2004

(65) Prior Publication Data

US 2005/0200345 A1 Sep. 15, 2005

(30) Foreign Application Priority Data

Mar. 11, 2004 (TW) ..... 93106540 A

(51) Int. Cl.
*G05F 3/16* (2006.01)

(52) U.S. Cl. ..... 323/315; 327/374; 327/543

(58) Field of Classification Search ..... 323/223–225, 323/311, 313–316; 327/374, 376, 377, 530, 327/534, 535, 537, 538, 543, 545
See application file for complete search history.

(56) References Cited

U.S. PATENT DOCUMENTS 5,939,937 A * 8/1999 Terletzki ..... 327/541
6,005,379 A * 12/1999 Wong et al. ..... 323/313
6,008,632 A * 12/1999 Sasaki ..... 323/313
6,333,623 B1 * 12/2001 Heisley et al. ..... 323/280
6,819,165 B1 * 11/2004 Ho et al. ..... 327/541

* cited by examiner

*Primary Examiner*—Gary L Laxton

(57) ABSTRACT

A source and sink voltage regulator includes an output circuit, an amplifier circuit and a bias current control circuit. The output circuit is used to output a loading current under a stable output voltage and is further used to draw a reverse loading current while a loading voltage is greater than the output voltage. The amplifier circuit maintains the output voltage at a predetermined normal output voltage. The bias current control circuit keeps the transistors of the output circuit under a predetermined static bias current to accelerate the response speed of the voltage regulator, automatically maintaining a balance status while the output circuit is working.

19 Claims, 1 Drawing Sheet

SOURCE AND SINK VOLTAGE REGULATOR

RELATED APPLICATIONS

The present application is based on, and claims priority from, Taiwan Application Serial Number 93106540, filed Mar. 11, 2004, the disclosure of which is hereby incorporated by reference herein in its entirety.

BACKGROUND OF THE INVENTION

1. Field of Invention

The invention relates to a voltage regulator and, in particular, to a source and sink voltage regulator.

2. Related Art

The development in electronic products has the trend of miniaturization and, therefore, complicated and delicate structures. The voltage stability and the response time to load variation of the power supply are two primary issues that concern researchers in the field. The size of devices directly affects the costs and profits of the manufacturers.

In order to ensure the stability of the voltage, the so-called voltage regulator is invented to maintain a predetermined normal output voltage. The voltage regulator may have different forms, such as a device form on large apparatus or a chip form on a circuit system. However, some conventional voltage regulators for the circuit system cannot draw a reverse loading current. Therefore, when the equivalent external loading voltage is too high, there is no way to lower it by drawing the current. Those voltage regulators with the function of outputting and drawing currents, on the other hand, have the problem of a slow response time. This is because when the voltage regulator changes from current output to current drawing, or vice versa, it always involves turning on some shutdown circuits. Such initialization of the shutdown circuits is the cause of delay in response time.

In addition, the output circuits of some conventional voltage regulators are composed of N-type metal oxide semiconductor (MOS) and P-type MOS. However, the P-type MOS has a lower drive capability. Therefore, one needs a larger chip area in order to provide the required current output. In summary, the properties of the voltage regulator can be improved if the chip area and the response time can be reduced at the same time.

SUMMARY OF THE INVENTION

An objective of the invention is to provide a voltage regulator that only uses the N-type MOS in the output circuit. This does not only reduce the required chip area, but also enhance the overall output power.

Another objective of the invention is to provide a source and sink voltage regulator, which provides an output current under a stable output voltage and further draws a reverse loading current while an equivalent loading voltage is greater than the output voltage.

A further objective of the invention is to provide a bias current control circuit so that the transistors of an output circuit operate at a predetermined bias voltage when they are idle. It maintains a static bias current in order to reduce the response time and to automatically keep a balance status while the output circuit is working.

In accord with the above objectives, the invention provides a source and sink voltage regulator that contains an output circuit, an amplifier circuit, and a bias current control circuit. The output circuit is used to output a loading current under a stable output voltage and is further used to draw a reverse loading current while a loading voltage is greater than the output voltage. The amplifier circuit maintains the output voltage at a predetermined normal output voltage. The bias current control circuit keeps the transistors of the output circuit under a predetermined static bias current to accelerate the response speed of the voltage regulator.

Using the disclosed voltage regulator increases both the usage rate of the chip area and the output power. It functions of outputting and drawing currents further keep the output circuit at a predetermined static bias current when the output circuit is idle. This greatly reduces the response time.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE PREFERRED EMBODIMENT

Figure 1:
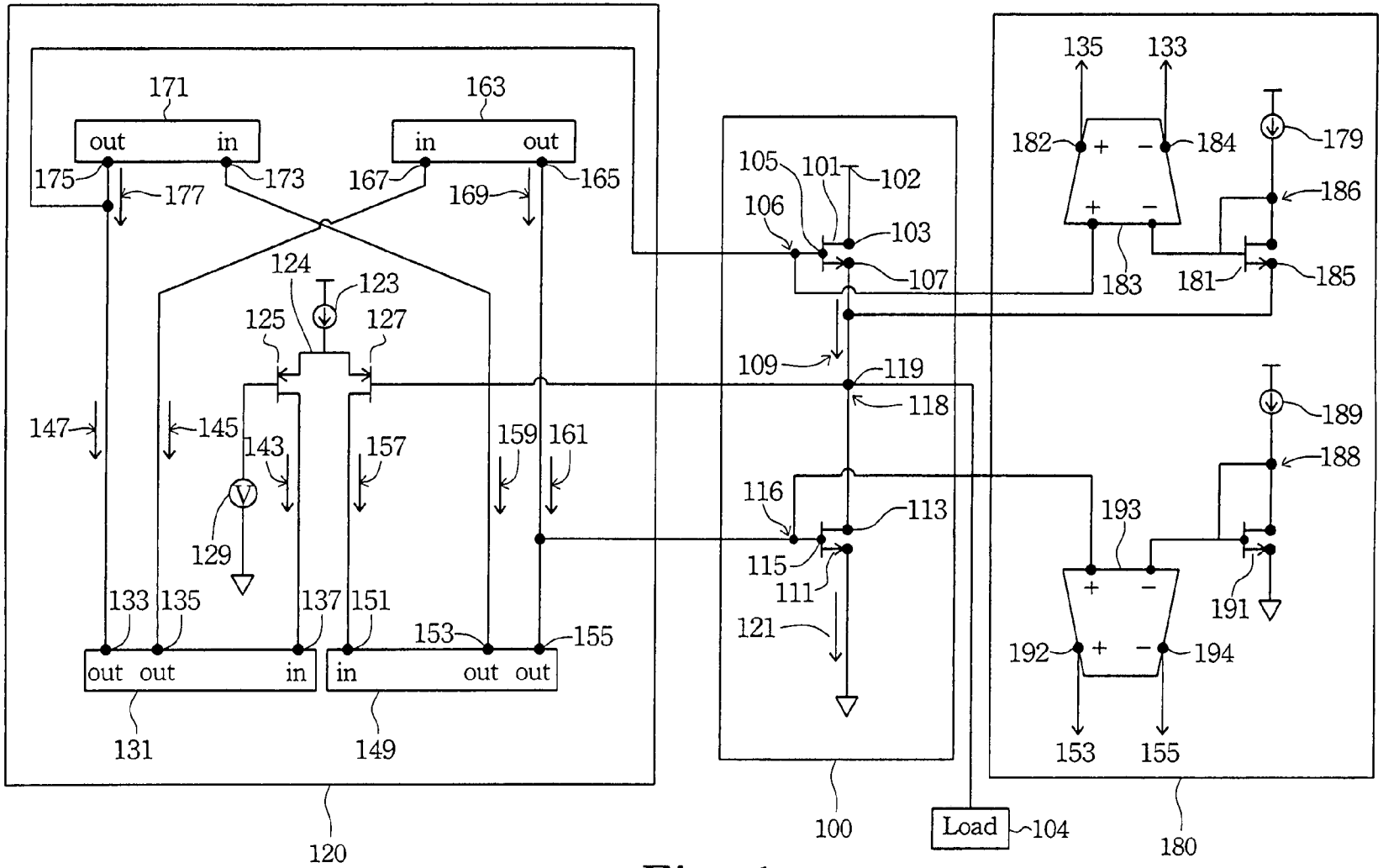
FIG. 1 shows a preferred embodiment of the disclosed source and sink voltage regulator.

As shown in FIG. 1, a preferred embodiment of the disclosed source and sink voltage regulator has an output circuit 100, an amplifier circuit 120, and a bias current control circuit 180.

The output circuit 100 is used to output a loading current on the load 104 under a stable output voltage 118. It is further used to draw a reverse loading current while a loading voltage on the load 104 is greater than the output voltage. The amplifier circuit 120 is connected to a reference voltage source 129 and to the output circuit 100 to maintain the output voltage 118 the same as the reference voltage source 129. The bias current control circuit 180 is also connected to the output circuit 100 to keep the transistors of the output circuit 100 under a predetermined static bias voltage and a corresponding predetermined static bias current, thereby reducing the response time.

The output circuit 100 contains an output terminal 119, a first transistor 101, and a second transistor 111. The output terminal 119 is connected to the load 104 and provides the output voltage 118. When the output voltage 118 is greater than the voltage of the load 104, the output circuit 100 provides a loading current. When the output voltage 118 is smaller than the voltage of the load 104, the output circuit 100 draws a reverse loading current. The first transistor 101 is an N-type metal oxide semiconductor (MOS). The first drain 103 is connected to an external power supply 102. The external power supply 102 is the input voltage source of the output voltage 118. The first gate 105 is used to receive a first voltage 106. The first source 107 is connected to the output terminal 119. The power provided by the external power supply 102 under the control of the first voltage 106 makes the first transistor 101 generate a first current 109. The second transistor 111 is also an N-type MOS. The second drain 113 is connected to the first source 107 and the output terminal 119. The second gate 115 is used to receive a second voltage 116 and controls the second transistor 111 to generate a second current 121.

When the voltage on the load 104 is smaller than the output voltage 118, a loading current flows from the output terminal 119 to the load system. Therefore, the voltage on the load 104 gradually increases until it is equal to the output voltage 118. On the other hand, when the voltage on the load 104 is higher than the output voltage 118, a reverse loading current flows from the load 104 to the output terminal 119. The voltage on the load 104 gradually decreases until it is equal to the output voltage 118.

The amplifier circuit 120 contains a current source 123, a reference voltage source 129, a first current mirror 131, a second current mirror 149, a third current mirror 163, a fourth current mirror 171, and a differential amplifying pair 124. The differential amplifying pair 124 contains a positive-phase input transistor 125 and a reverse-phase input transistor 127.

The amplifier circuit 120 maintains the output voltage 118 at a predetermined normal output voltage. The current source 123 provides the current required by the differential amplifying pair 124. The positive-phase input transistor 125 is connected to the current source 123 and is controlled by the reference voltage source 129 to provide a positive-phase current 143. The positive-phase current 143 is received by the first input terminal 137 of the first current mirror 131 as the mirror source. A first mirror current 145 equal to the positive-phase current 143 is generated at the first mirror terminal 135. A second mirror current 147 is generated at the second mirror terminal 133.

The reverse-phase input transistor 127 is also connected to the current source 123 and to the output terminal 119 for receiving the output voltage 118 as a reverse-phase feedback and to provide a reverse-phase current 157. The reverse-phase current 157 is received by the second input terminal 151 of the second current mirror 149 as the mirror source. A third mirror current 159 equal to the reverse-phase current 157 is generated at the third mirror terminal 153. A fourth mirror current 161 is generated at the fourth mirror terminal 155.

The third current mirror 163 contains a third input terminal 167 connected to the first mirror terminal 135 and a fifth mirror terminal 165 connected to the fourth mirror terminal 155. The third input terminal 167 uses the first mirror current 145 as the mirror source to generate a fifth mirror current 169 equal to the first mirror current 145. Likewise, the fourth current mirror 171 contains a fourth input terminal 173 connected to the third mirror terminal 153 and a sixth mirror terminal 175 connected to the second mirror terminal 133. The fourth input terminal 173 uses the third mirror current 159 as the mirror source to generate a sixth mirror current 177 equal to the third mirror current 159.

The amplifier circuit 120 utilizes the interactions between the differential amplifying pair 124 and the first current mirror 131, the second current mirror 149, the third current mirror 163, and the fourth current mirror 171 to keep the output voltage 118 equal to the value of the reference voltage source 129. When the output voltage 118 is smaller than the value of the reference voltage source 129, the reverse-phase current 157 increases accordingly while the positive-phase current 143 decreases. Therefore, the fourth mirror current 161 increases with the reverse-phase current 157, and the fifth mirror current 169 decreases with the positive-phase current 143. The net result is to lower the second voltage 116.

Using the same action principle, the value of the second mirror current 147 decreases while that of the sixth mirror current 177 increases. Thus, the first voltage 106 increases. The result of increasing the first voltage 106 and lowering the second voltage 116 pulls up the output voltage 118.

According to the above-mentioned action principle, if the output voltage 118 is higher than the value of the reference voltage source 129, the reverse-phase current 157 decreases while the positive-phase current 143 increases. Therefore, the second mirror current 147 increases with the positive-phase current 143, and the sixth mirror current 177 decreases with the reverse-phase current 157. The net result is to lower the first voltage 106.

Using the same action principle, the value of the fourth mirror current 161 decreases while that of the fifth mirror current 169 increases. Thus, the second voltage 116 increases. The result of lowering the first voltage 106 and increasing the second voltage 116 pulls down the output voltage 118.

The bias current control circuit 180 is used to make the first transistor 101 and the second transistor 111 operate at a predetermined static bias voltage in order to generate a predetermined static bias current when they are idle. It is further kept in a balance status while the output circuit 100 is working, instead of affecting the output voltage 118 at the output terminal 119. The bias current control circuit 180 contains a third transistor 181, a fourth transistor 191, a first transconduction amplifier 183, and a second transconduction amplifier 193. The third transistor 181 is connected to the first transconduction amplifier 183 and to the first reference current source 179 to receive a first reference current and to generate a first reference voltage 186. The size of the third transistor 181 is 1/N of the first transistor 101, and the third source 185 is connected with the first source 107. In general, N is a positive number. Therefore, when the first voltage 106 of the first transconduction amplifier 183 is equal to the first reference voltage 186, the first current 109 is N times that flowing through the third transistor 181.

Likewise, the size of the fourth transistor 191 is selected to be 1/M of the second transistor 111. Therefore, when the second voltage 116 is equal to the second reference voltage 188, the second current 121 is M times that flowing through the fourth transistor 191. Through such a choice, the current flowing through the transistor in the output circuit 100 can be controlled. Therefore, the bias current control circuit 180 can use the third transistor 181 and the fourth transistor 191 of smaller sizes to control the larger current on the output circuit 100. This can effectively reduce the volume required by the bias current control circuit 180.

We explain in detail the functional principles of the bias current control circuit 180 as follows. The first transconduction amplifier 183 contains a first feedback terminal 182 connected to the first mirror terminal 135 and a second feedback terminal 184 connected to the second mirror terminal 133 (the connection not shown in the drawing). The second transconduction amplifier 193 contains a third feedback terminal 192 connected to the third mirror terminal 153 and a fourth feedback terminal 194 connected to the fourth mirror terminal 155 (the connection not shown in the drawing).

When the output circuit 100 is in its idle status, namely, the output terminal 119 has no output current in or out of the load 104, the first current 109 is equal to the second current 121. At this moment, if the first current 109 is greater than N times the current on the first reference current source 179, the first voltage 106 is greater than the first reference voltage 186. Through the function of the amplifier circuit 120, the first transconduction amplifier 183 makes the first voltage 106 and the second voltage 116 drop simultaneously, thereby decreasing the first current 109 and the second current 121.

At the same time, a preferred circuit design of the invention makes the M times the current on the second reference current source 189 equal to the N times current on the first reference current source 179. Therefore, the second current 121 is greater than M times the current on the second reference current source 189; that is the second voltage 116 is greater than the second reference voltage 188. The second transconduction amplifier 193 simultaneously decreases the first voltage 106 and the second voltage 116 in order to lower the first current 109 and the second current 121. In other words, the first transconduction amplifier 183 and the second transconduction amplifier 193 simultaneously lower the first voltage 106 and the second voltage 116, thereby lowering the first current 109 and the second current 121 until reaching the predetermined static bias current. The predetermined static bias current is roughly equal to N times the current on the first reference current source 179 and to M times the current on the second reference current source 189. Thus, the bias current control circuit 180 controls the output circuit 100 at a predetermined static bias voltage.

On the other hand, if the first current 109 is smaller than N times the current on the first reference current source 179 and the second current 121 is smaller than M times the current on the second reference current source 189, the first transconduction amplifier 183 raises the first voltage 106 and the second voltage 116 in order to increase the first current 109 and the second current 121.

At the same time, the second transconduction amplifier 193 also increases the first voltage 106 and the second voltage 116 simultaneously in order to increase the first current 109 and the second current 121. That is, the transconduction amplifier 183 and the second transconduction amplifier 193 simultaneously increase the first voltage 106 and the second voltage 116 in order to increase the first current 109 and the second current 121 until reaching the predetermined static bias current.

Therefore, when the output circuit 100 is idle, the bias current control circuit 180 can effectively keep the first current 109 and the second current 121 at a static bias current to accelerate the response speed of the voltage regulator.

When the current output from the output circuit 100 flows via the output terminal 119 to the load 104, the amplifier circuit 120 increases the first voltage 106 and lowers the second voltage 116 in order to maintain the output voltage 118 the same as the reference voltage source 129. The output current from the output terminal 119 to the load 104 is thus equal to the difference between the first current 109 and the second current 121.

Since the first voltage 106 is greater than the first reference voltage 186 (i.e. the first current 109 is greater than N times the current on the first reference current source 179), the first transconduction amplifier 183 lowers the first voltage 106 and the second voltage 116 simultaneously.

At the same time, as the second voltage 116 is smaller than the second reference voltage 188 (i.e. the second current 121 is smaller than M times the current on the second reference current source 189), the second transconduction amplifier 193 increases the first voltage 106 and the second voltage 116 simultaneously.

Due to the simultaneous actions of the first transconduction amplifier 183 and the second transconduction amplifier 193, the bias current control circuit 180 reaches a balance status. The influences on the first voltage 106 and the second voltage 116 cancel with each other. Therefore, the bias current control circuit 180 does not cause any bias error on the output voltage 118.

When the output circuit 100 draws a reverse loading current from the load 104 via the output terminal 119, the amplifier circuit 120 lowers the first voltage 106 and raises the second voltage 116 in order to maintain the output voltage 118 the same as the reference voltage source 129. The reverse loading current flowing from the output terminal 119 plus the first current 109 is released via the second current 121.

Since the first voltage 106 is smaller than the first reference voltage 186 (i.e. the first current 109 is smaller than N times the current on the first reference current source 179), the first transconduction amplifier 183 raises the first voltage 106 and the second voltage 116 simultaneously.

At the same time, as the second voltage 116 is greater than the second reference voltage 188 (i.e. the second current 121 is greater than M times the current on the second reference current source 189), the second transconduction amplifier 193 lowers the first voltage 106 and the second voltage 116 simultaneously.

Due to the simultaneous actions of the first transconduction amplifier 183 and the second transconduction amplifier 193, the bias current control circuit 180 reaches a balance status when the difference between the first voltage 106 and the first reference voltage 186 is equal to that between the second reference voltage 188 and the second voltage 116. The influences on the first voltage 106 and the second voltage 116 cancel with each other. Therefore, the bias current control circuit 180 does not cause any bias error on the output voltage 118.

Therefore, when the output circuit 100 is idle, the bias current control circuit 180 effectively keeps it at the predetermined static bias current to accelerate the response speed of the voltage regulator. At the same time, when the output circuit 100 provides the load a current or draws a current from the load 104, it automatically reaches a balance without having a bias error. The output circuit 100 can thus be maintained at an output voltage 118 equal to the reference voltage source 129.

From the above description, we see that the disclosed voltage regulator uses only N-type MOS to make an output circuit to provide bi-directional load currents. It occupies a smaller chip area. The invention further provides a bias current control circuit to maintain the output circuit at a predetermined static bias current when the transistors are idle. This reduces the response time of the output circuit. When the output circuit is working, the bias current control circuit cancels the influence so that the output voltage from the output circuit is not affect at all. We use a small-area control circuit to control the output circuit with a large current output. As a result, the required size of the control circuit is effectively reduced.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A source and sink voltage regulator comprising:

an output circuit, which is connected to a load and comprised of a plurality of transistors made of N-type metal oxide semiconductor (MOS), wherein a load current is generated when an output voltage of the output circuit is greater than an equivalent load voltage on the load and a reverse loading current is drawn when the output voltage is smaller than the equivalent load voltage;

an amplifier circuit, which is coupled to a voltage source and the output circuit for adjusting the output voltage to a predetermined voltage; and a bias current control circuit, which is connected to the output circuit and the amplifier circuit, keeps the plurality of transistors at a predetermined static bias current to accelerate the response speed of the voltage regulator, maintaining a balance status while the output circuit is working.

2. The voltage regulator of claim 1, wherein the output circuit comprises:

an output terminal, which is used to output the loading current and to draw the reverse loading current;

a first transistor, including:

a first gate for receiving a first voltage;

a first drain connected to an external power supply that provides the output voltage;

a first source connected to the output terminal, wherein the first voltage controls the first transistor to produce a first current output to the output terminal; and a second transistor, including:

a second gate for receiving a second voltage; and a second drain connected to the first source and the output terminal, wherein the second voltage controls the second transistor to produce a second current.

3. The voltage regulator of claim 2, wherein the amplifier circuit comprises:

a current source, which provides a predetermined current;

a differential pair, which is coupled to the current source to receive the predetermined current and is composed of:

a positive-phase input transistor, which is connected to the current source and to the voltage source for providing a positive-phase current; and a reverse-phase input transistor, which is connected to the current source and to the output terminal for taking the output voltage as a reverse-phase feedback and providing a reverse-phase current;

a first current mirror, which contains one input terminal and two mirror terminals, connects to the positive-phase input transistor to receive the positive-phase current, and generates a first mirror current and a second mirror current both equal in value to the positive-phase current;

a second current mirror, which contains one input terminal and two mirror terminals, connects to the reverse-phase input transistor to receive the positive-phase current, and generates a third mirror current and a fourth mirror current both equal in value to the reverse-phase current;

a third current mirror, which contains one input terminal and one mirror terminal, connects to the second current mirror and uses the first mirror current as a mirror source, and generates a fifth mirror current equal in value to the first mirror current; and a fourth current mirror, which contains one input terminal and one mirror terminal, connects to the first current mirror and the second current mirror and uses the first mirror current as a mirror source, and generates a sixth mirror current equal in value to the first mirror current.

4. The voltage regulator of claim 3, wherein the amplifier circuit increases the positive-phase current and decreases the reverse-phase current when the output voltage is greater than the voltage source so that the fourth mirror current decreases and the fifth mirror current increases to increase the second voltage, increasing the second mirror current and decreasing the sixth mirror current to reduce the first voltage, and the result of decreasing the first voltage and increasing the second voltage reduces the output voltage to equal to the value of the voltage source.

5. The voltage regulator of claim 3, wherein the amplifier circuit decreases the positive-phase current and increases the reverse-phase current when the output voltage is smaller than the voltage source so that the fifth mirror current decreases and the fourth mirror current increases to decrease the second voltage, decreasing the second mirror current and increasing the sixth mirror current to increase the first voltage, and the result of increasing the first voltage and decreasing the second voltage raises the output voltage to equal to the value of the voltage source.

6. The voltage regulator of claim 3, wherein the bias current control circuit contains:

a first reference current source, which provides a first reference current;

a third transistor, which is connected to the first reference current source to receive the first reference current and to generates a first reference voltage;

a second reference current source, which provides a second reference current;

a fourth transistor, which is connected to the second reference current source to receive the second reference current and to generates a second reference voltage;

a first transconduction amplifier, which is connected to the first transistor, the third transistor, a first mirror terminal and a second mirror terminal of the first current mirror; wherein the first transconduction amplifier uses the amplifier circuit to decrease the first voltage and the second voltage simultaneously when the first voltage is greater than the first reference voltage and to increase the first voltage and the second voltage simultaneously when the first voltage is smaller than the first reference voltage; and a second transconduction amplifier, which is connected to the second transistor, the fourth transistor, a third mirror terminal and a fourth mirror terminal of the second current mirror; wherein the second transconduction amplifier uses the amplifier circuit to decrease the first voltage and the second voltage simultaneously when the second voltage is greater than the second reference voltage and to increase the first voltage and the second voltage simultaneously when the second voltage is greater than the second reference voltage.

7. The voltage regulator of claim 6, wherein the predetermined static bias current is equal to the first current and the second current when the output circuit is idle.

8. The voltage regulator of claim 7, wherein the predetermined static bias current is roughly N times the first reference current when the size of the first transistor is equal to N times that of the third transistor.

9. The voltage regulator of claim 8, wherein the predetermined static bias current is roughly M times the second reference current when the size of the second transistor is equal to M times that of the fourth transistor.

10. The voltage regulator of claim 6, wherein the bias current control circuit keeps a balancing status when the output circuit is working so that the effects of the first transconduction amplifier and the first transconduction amplifier on the amplifier circuit cancel with each other.

11. The voltage regulator of claim 10, wherein (the first voltage−the first reference voltage)=(the second voltage−the second reference voltage) when the bias current control circuit is in its balancing status.

12. A source and sink voltage regulator comprising:

an output circuit, which contains:

an output terminal, which is connected to a load, wherein a load current is generated when an output voltage of the output circuit is greater than an equivalent load voltage on the load and a reverse loading current is drawn when the output voltage is smaller than the equivalent load voltage;

a first transistor, which is an N-type MOS and includes a first gate for receiving a first voltage, a first drain connected to an external power supply that provides the output voltage, and a first source connected to the output terminal, wherein the first voltage controls the first transistor to produce a first current output to the output terminal; and a second transistor, which is an N-type transistor and includes a second gate for receiving a second voltage, and a second drain connected to the first source and the output terminal, wherein the second voltage controls the second transistor to produce a second current;

an amplifier circuit, which is coupled to a voltage source and the output circuit for adjusting the output voltage to a predetermined voltage and further contains:

a current source, which provides a predetermined current;

a differential pair, which is coupled to the current source to receive the predetermined current and is composed of:

a positive-phase input transistor, which is connected to the current source and to the voltage source for providing a positive-phase current; and a reverse-phase input transistor, which is connected to the current source and to the output terminal for taking the output voltage as a reverse-phase feedback and providing a reverse-phase current;

a first current mirror, which contains one input terminal and two mirror terminals, connects to the positive-phase input transistor to receive the positive-phase current, and generates a first mirror current and a second mirror current both equal in value to the positive-phase current; and a second current mirror, which contains one input terminal and two mirror terminals, connects to the reverse-phase input transistor to receive the positive-phase current, and generates a third mirror current and a fourth mirror current both equal in value to the reverse-phase current; and a bias current control circuit, which is connected to the output circuit and the amplifier circuit, keeps the plurality of transistors at a predetermined static bias current to accelerate the response speed of the voltage regulator, maintaining a balance status while the output circuit is working; wherein the bias current control circuit is further connected to the amplifier circuit for providing a plurality of currents to the amplifier circuit and for receiving a plurality of reverse feedback currents from the amplifier circuit, and contains:

a first reference current source, which provides a first reference current;

a third transistor, which is connected to the first reference current source to receive the first reference current and to generates a first reference voltage;

a second reference current source, which provides a second reference current;

a fourth transistor, which is connected to the second reference current source to receive the second reference current and to generates a second reference voltage;

a first transconduction amplifier, which is connected to the first transistor, the third transistor, a first mirror terminal and a second mirror terminal of the first current mirror; wherein the first transconduction amplifier uses the amplifier circuit to decrease the first voltage and the second voltage simultaneously when the first voltage is greater than the first reference voltage and to increase the first voltage and the second voltage simultaneously when the first voltage is smaller than the first reference voltage; and a second transconduction amplifier, which is connected to the second transistor, the fourth transistor, a third mirror terminal and a fourth mirror terminal of the second current mirror; wherein the second transconduction amplifier uses the amplifier circuit to decrease the first voltage and the second voltage simultaneously when the second voltage is greater than the second reference voltage and to increase the first voltage and the second voltage simultaneously when the second voltage is greater than the second reference voltage.

13. The voltage regulator of claim 12, wherein the amplifier circuit increases the positive-phase current and decreases the reverse-phase current when the output voltage is greater than the voltage source so that the fourth mirror current decreases and the fifth mirror current increases to increase the second voltage, increasing the second mirror current and decreasing the sixth mirror current to reduce the first voltage, and the result of decreasing the first voltage and increasing the second voltage reduces the output voltage to equal to the value of the voltage source.

14. The voltage regulator of claim 12, wherein the amplifier circuit decreases the positive-phase current and increases the reverse-phase current when the output voltage is smaller than the voltage source so that the fifth mirror current decreases and the fourth mirror current increases to decrease the second voltage, decreasing the second mirror current and increasing the sixth mirror current to increase the first voltage, and the result of increasing the first voltage and decreasing the second voltage raises the output voltage to equal to the value of the voltage source.

15. The voltage regulator of claim 12, wherein the predetermined static bias current is equal to the first current and the second current when the output circuit is idle.

16. The voltage regulator of claim 15, wherein the predetermined static bias current is roughly N times the first reference current when the size of the first transistor is equal to N times that of the third transistor.

17. The voltage regulator of claim 16, wherein the predetermined static bias current is roughly M times the second reference current when the size of the second transistor is equal to M times that of the fourth transistor.

18. The voltage regulator of claim 14, wherein the bias current control circuit keeps a balancing status when the output circuit is working so that the effects of the first transconduction amplifier and the first transconduction amplifier on the amplifier circuit cancel with each other.

19. The voltage regulator of claim 18, wherein (the first voltage−the first reference voltage)=(the second voltage−the second reference voltage) when the bias current control circuit is in its balancing status.

* * * * *

UNITED STATES PATENT AND TRADEMARK OFFICE

CERTIFICATE OF CORRECTION

PATENT NO. : 7,002,332 B2
APPLICATION NO. : 10/971944
DATED : February 21, 2006
INVENTOR(S) : An-Tung Chen and Ching-Wei Hsueh It is certified that error appears in the above-identified patent and that said Letters Patent is hereby corrected as shown below:

On the title page item (73), Column 1, under Assignee, Line 2, After "(TW)" insert --R.O.C.--.

On the title page item (75), Column 1, under Inventors, Line 1, Delete "(TW);" and insert --(TW) R.O.C.;--, therefor.

On the title page item (75), Column 1, under Inventors, Line 2, After "(TW)" insert --R.O.C.--.

Signed and Sealed this

Second Day of January, 2007

JON W. DUDAS
*Director of the United States Patent and Trademark Office*